US009767664B2

(12) United States Patent
Kim et al.

(10) Patent No.: US 9,767,664 B2
(45) Date of Patent: Sep. 19, 2017

(54) FIRE AND GAS DETECTION SYSTEM HAVING BIDIRECTIONAL COMMUNICATION FUNCTION TO BE INSTALLED IN DANGEROUS REGION

(71) Applicant: B-I INDUSTRIAL CO., LTD., Seoul (KR)

(72) Inventors: Yeong Soo Kim, Busan (KR); Min Woo Jung, Gyeongsangnam-do (KR)

(73) Assignee: B-I INDUSTRIAL CO., LTD., Seoul (KR)

( * ) Notice: Subject to any disclaimer, the term of this patent is extended or adjusted under 35 U.S.C. 154(b) by 0 days.

(21) Appl. No.: 15/118,655

(22) PCT Filed: Jun. 27, 2014

(86) PCT No.: PCT/KR2014/005755
§ 371 (c)(1),
(2) Date: Oct. 20, 2016

(87) PCT Pub. No.: WO2015/122579
PCT Pub. Date: Aug. 20, 2015

(65) Prior Publication Data

US 2017/0061756 A1 Mar. 2, 2017

(30) Foreign Application Priority Data

Feb. 13, 2014 (KR) ..... 10-2014-0016563

(51) Int. Cl.
*G08B 17/10* (2006.01)
*G08B 17/06* (2006.01)
*G08B 25/08* (2006.01)

(52) U.S. Cl.
CPC ..... *G08B 17/10* (2013.01); *G08B 17/06* (2013.01); *G08B 25/08* (2013.01)

(58) Field of Classification Search
CPC ..... G08B 17/10; G08B 17/06; G08B 25/08; G08B 21/18; G08B 21/182; G08B 29/04;
(Continued)

(56) References Cited

U.S. PATENT DOCUMENTS 4,287,515 A * 9/1981 Raber ..... G08B 29/06 340/506
8,760,280 B2 * 6/2014 Piccolo, III ..... G08B 17/00 307/117

(Continued)

FOREIGN PATENT DOCUMENTS

JP 11-066451 3/1999
JP 2010-027070 2/2010

(Continued)

OTHER PUBLICATIONS

International Search Report for PCT/KR2014/0016563, mailed Aug. 29, 2014, 2 pages.

*Primary Examiner* — Anh V La
(74) *Attorney, Agent, or Firm* — Nixon & Vanderhye P.C.

(57) ABSTRACT

A fire and gas detection system, which has a bidirectional communication function and is to be installed in a dangerous region, according to the present invention, comprises: a first terminal block and a second terminal block; a +line and a −line; a first loop line wherein a part of a loop shape thereof is arranged to extend over a dangerous region having a relatively high dangerousness of disaster occurrence and the other part of the loop shape is arranged in a safe region other than the dangerous region, and a second loop line arranged in parallel to the first loop line in the same shape; a first connection line and a second connection line; a barrier which is installed in the first connection line and the second connection line and disconnects the first connection line and the second connection line when short-circuiting between the first loop line and the second loop line is detected; a (Continued)

sensor connected to the first loop line and the second loop line inside the dangerous region; and a CPU which simultaneously controls the first and second terminal blocks to modulate and output call information designating a sensor at a first voltage and demodulate detection information from a second voltage, and performs fire and gas detection warning processing in accordance with the demodulated detection information.

10 Claims, 5 Drawing Sheets

(58) Field of Classification Search
CPC .... G08B 29/02; G08B 29/185; G08B 29/181; A62C 3/16; A62C 3/08; H05B 33/0857; H05B 33/0803; H05B 33/0863; H05B 37/0272
USPC ..... 340/628, 632, 584, 540, 577, 629–631, 340/634
See application file for complete search history.

(56) References Cited

U.S. PATENT DOCUMENTS

| | | | | |
|---|---|---|---|---|
| 2002/0145513 | A1* | 10/2002 | Ropke ..... | G08B 25/10 340/506 |
| 2014/0062705 | A1* | 3/2014 | Rauworth ..... | G08B 17/04 340/632 |

FOREIGN PATENT DOCUMENTS

| | | |
|---|---|---|
| KR | 10-1208843 | 12/2012 |
| KR | 10-1311950 | 9/2013 |

* cited by examiner

FIRE AND GAS DETECTION SYSTEM HAVING BIDIRECTIONAL COMMUNICATION FUNCTION TO BE INSTALLED IN DANGEROUS REGION

TECHNICAL FIELD

The present invention relates to a fire and gas detection system for being installed in a dangerous region whit a bidirectional communication function, and more particularly, to a fire and gas detection system having a bidirectional communication function implemented such that a power supply function to and a power line communication function with a sensor installed within a relative high dangerous region are maintained even at the disaster occurrence.

BACKGROUND OF THE INVENTION

In order to sense fire occurrence or gas leakage in a large space such as an inside/outside of a ship and an inside/outside of a plant or a building, a smoke sensor for sensing smoke generation, a temperature sensor for sensing surrounding temperatures, a flame sensor for sensing flame generation, etc. have been installed, and thus a system for detecting the fire occurrence or gas leakage according to the operation of the respective sensors has been used.

As an example of such a system, Korean Patent No. 1311950 (Sep. 17, 2013) entitled a fire and gas detection system having a bidirectional communication loop is disclosed (hereinafter, referred to as the conventional art).

According to the conventional art the fire and gas detection system including: a communication loop including (+) line to which an operating voltage and a digital call signal are supplied and (−) line which is arranged in parallel to the (+) line; a fire detecting sensor which is connected to the communication loop, and analyzes the digital call signal and transmits a measurement value in the form of a current signal, at the time when the fire detecting sensor itself is called; an interface unit which includes a loop A terminal and a loop B terminal, applies the operating voltage and the digital call signal to the (+) line, and receives the current signal outputted by the fire detecting sensor from the (−) line; and a main control panel which is connected to the interface unit, provides the digital call signal, and receives the measurement value from the called fire detecting sensor and then processes the measurement value according to a pre-inputted program, is disclosed.

However, even in case where such a bidirectional communication loop is used, in a dangerous region in which a disaster occurrence possibility is relatively high, sensors are arranged in parallel between (+) line and (−) line and a single direction communication not a bidirectional communication is used. If such a single direction communication is used, in case within a dangerous region the (+) line and the (−) line melt and stick together by heat or flame to be shorted as a result of fire occurrence and gas leak within a dangerous region, power supply function and power line communication function through the lines both become impossible.

Hence, there is a need for a new technology for handling the short of the (+) line and the (−) line as well as the disconnection of one of the (+) line and the (−) line disclosed in the conventional invention.

SUMMARY OF THE INVENTION

To solve the above problems, the object of the invention is to maintain the functionality of a fire and gas detection system at most even when the line to which (+) voltage is applied and the line to which (−) voltage is applied are respectively disconnected or are shorted, in the fire and gas detection system installed in a dangerous region having a high level of danger of the disaster occurrence.

According to an embodiment, a fire and gas detection system having a bidirectional communication function and installed within a dangerous region, the fire and gas detection system may comprises: a first terminal board including a first terminal for outputting a first voltage and a second terminal for outputting a second voltage; and a second terminal board including a third terminal for outputting a first voltage and a fourth terminal for outputting a second voltage; +line which connects the first terminal with the third terminal; and −line which connects the second terminal with the fourth terminal; a first loop line, which is a line formed in the form of a closed loop, wherein a part of the loop is arranged in the dangerous region with a possibility of disaster occurrence and the other part thereof is arranged in a safe region which is the remaining region except the dangerous region; and a second loop line which has the same type as that of the first loop line and is arranged in parallel to the first loop line; a first connection line which is branched from the +line and is connected to the first loop line; and a second connection line which is branched from the −line and is connected to the second loop line; a barrier which is installed between the first connection line and the second connection line, and disconnects the first connection line and the second connection line respectively when a short circuit between the first loop line and the second loop line is detected; a sensor which is connected to the first loop line and the second loop line within the dangerous region, is operated by the first voltage supplied through the first loop line, is generates sensed information by sensing a surrounding environment, and transmits the sensed information by modulating the second voltage if a predetermined call information is received by demodulating the first voltage; and a central processing unit (CPU) which controls the first and second terminal boards so that the call information which designates the sensor is modulated and outputted in addition to the first voltage and the sensed information which is transmitted from the sensor is demodulated from the second voltage, and performs an alarm process of occurrence of fire or gas in response to the demodulated sensed information.

According to a further embodiment, the sensor comprises at least one of a fire detecting sensor, a temperature sensor, a smoke sensor, a gas sensor, an open-close detector, a motion sensor, a manually operable switch, an explosion sensor, and a flame sensor.

According to a further embodiment, the system further comprises: an isolator circuit which includes +VDD terminal which is coupled with the first loop line; −IN terminal which is coupled with one cut end of the second loop line which has been cut; −OUT terminal which is coupled with the other cut end thereof; and a driving circuit unit which connects the −IN terminal with the −OUT terminal if a first voltage is applied to the +VDD terminal only, and isolates the −OUT terminal from the −IN terminal if the first voltage is applied also to the −OUT terminal while the first voltage is applied to the +VDD terminal.

According to a further embodiment, the driving circuit unit of the isolator circuit comprises: a first diode an anode of which is coupled with the −OUT terminal; a second diode an anode of which is coupled with the −IN terminal and a cathode of which is coupled with the cathode of the first diode; a first resistor and a second resistor one ends of which are respectively coupled with the cathodes of the first and second diodes; a first switching device a base of which is coupled with the other end of the first resistor and an emitter of which is coupled with the +VDD terminal; a second switching device a drain of which is coupled with the −OUT terminal and a source of which is coupled with the other end of the second resistor; a third switching device a drain of which is coupled with the −IN terminal and a source of which is coupled with the other end of the second resistor; and a third resistor one end of which is coupled with a collector of the first switching device and the other end of which is commonly coupled with gates of the second and third switching devices.

According to a further embodiment, the first switching device is a PNP transistor, and the second and third switching devices are N channel FET.

According to another embodiment, a fire and gas detection system having a bidirectional communication function and installed within a dangerous region comprises: a first loop line and a second loop line which are formed in the form of a closed loop and are parallel to each other, wherein a part of the loop shape is arranged in the dangerous region with a possibility of disaster occurrence, and the remaining part thereof is arranged in a safe region which is the remaining region except the dangerous region; a barrier which is coupled with the first loop line and the second loop line of the safe region, applies a first voltage to the first loop line, and releases the coupling with the first loop line and the second loop line when a short circuit between the first loop line and the second loop line is detected; a sensor which is operated by a first voltage supplied through the first loop line generates sensed information by sensing a surrounding environment within the dangerous region, and transmits the sensed information by modulating the second voltage of the second loop line if a predetermined call information is received by demodulating the first voltage; and a central processing unit (CPU) which is coupled with the barrier, demodulates the sensed information transmitted from the sensor with the second voltage while modulating the call information which designates the sensor and outputting it to the first voltage, and performs an alarm process of occurrence of fire and gas, in response to the demodulated sensed information.

According to a further embodiment, the system further may comprise an isolator circuit which includes, +VDD terminal which is coupled with the first loop line; −IN terminal which is coupled with one cut end of the second loop line which has been cut; −OUT terminal which is coupled with the other end thereof; and a driving circuit unit which connects the −IN terminal with the −OUT terminal if the first voltage is applied to the +VDD terminal only, and isolates the −OUT terminal from the −IN terminal if the first voltage is applied also to the −OUT terminal while the first voltage is applied to the +VDD terminal, wherein the sensor is connected to the first loop line and the second loop line through the isolator circuit.

DETAILED DESCRIPTION OF THE PREFERRED EMBODIMENTS

A fire and gas detection system having a bidirectional communication function according to the present invention is based on a fire and gas detection system in which a bidirectional communication function disclosed in the above described conventional art is implemented. Hence, the principle of operation and configuration thereof may be understood with reference to the above described conventional art.

Figure 1:
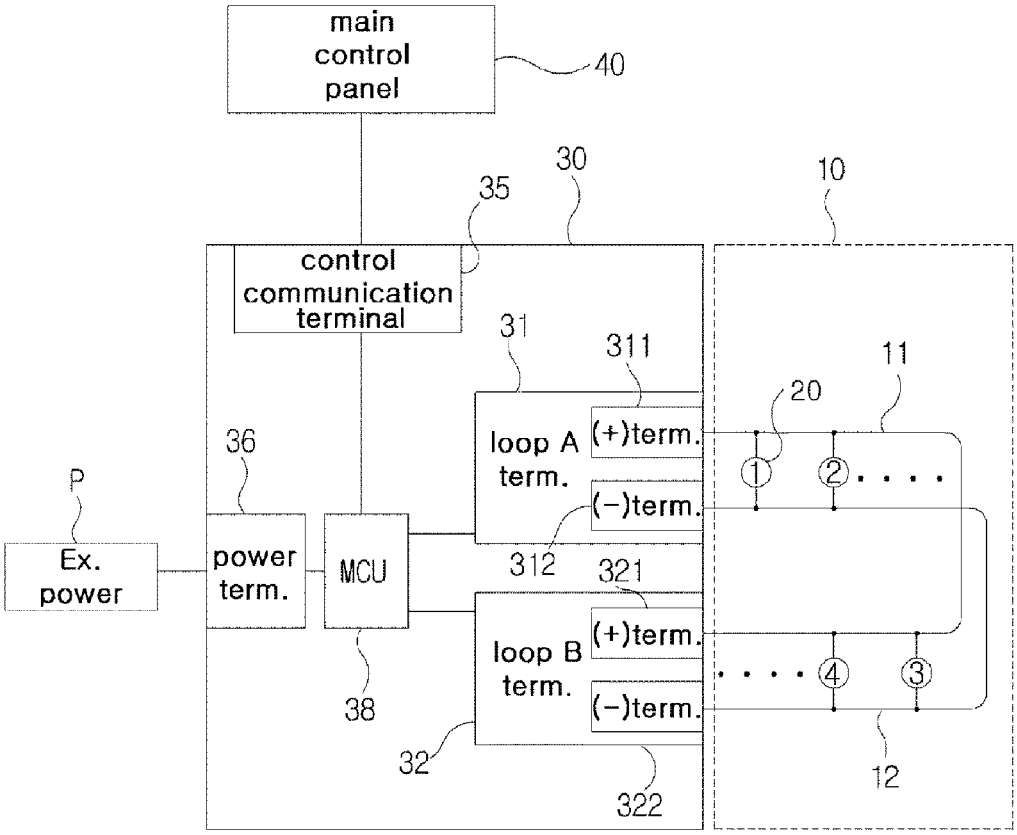
FIG. 1 is a block diagram illustrating a configuration of a fire and gas detection system having a bidirectional communication function according to a conventional art.
Figure 2:
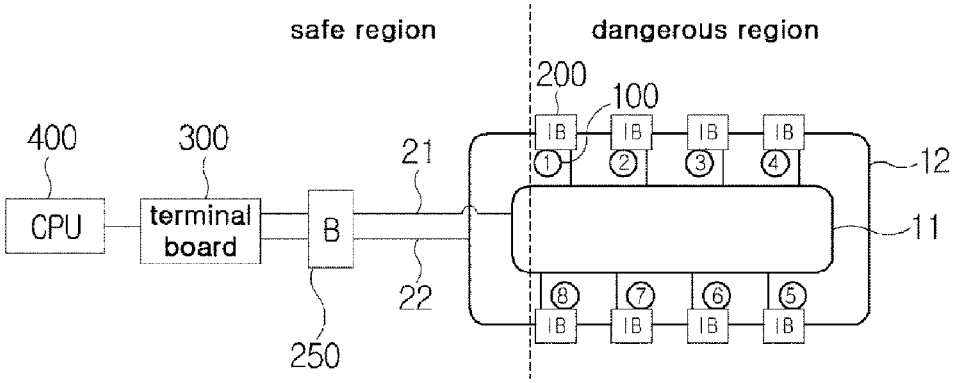
FIG. 2 is a conceptual diagram illustrating the configuration of a fire and gas detection system which has a bidirectional communication function and is installed within a dangerous region according to a first embodiment of the present invention.

First, the internal circuit configuration of a fire and gas detection system having a bidirectional communication function according to a first embodiment of the present invention is described with reference to FIG. 2. Referring to FIG. 2, the fire and gas detection system having the bidirectional communication function according to the first embodiment of the present invention may include: a first loop line 11 and a second loop line 12; a terminal board 300; a sensor 100; an isolator circuit 200, and a CPU 400.

Further, the first and gas detection system may further include a first connection line 21 and a second connection line 22 for connecting the first loop line 11 and the second loop line 12 respectively with the terminal board 300, and a barrier 250 which disconnects/connects the first connection line and the second connection line from/to the terminal board 300.

The first loop line 11 is formed in the form of a closed loop. It is arranged such that a portion of the loop may pass through the dangerous region and the remaining portion thereof may be arranged in a safe region.

The second loop line 12 has the same shape as that of the first loop line 11 and is configured to be parallel with the first loop line 11. Of course, all of the first loop line 11 and the second loop line 12 may also be configured to be arranged in the dangerous region.

Here, the dangerous region means a region where the possibility of disasters such as fire occurrence and gas leak is relatively high within a predetermined space. For example, in the case of a ship, the dangerous region may include a space for accommodating engines and fuel, a space for accommodating explosive or volatile material, and a place where fire or hot heat is used. In particular, according to the international Maritime Organization, cargo tanks, paint storages, and airtight spaces are specified as a dangerous region.

Meanwhile, a safe region is a region where the possibility of disasters is relatively low compared to the dangerous region. For example, in the case of a ship, the safe region may include bedrooms, shower rooms, resting rooms and the outside of cabins, etc. In particular, according to the International Maritime Organization, the remaining part except a dangerous region is specified as a safe region.

The terminal board 300 may be installed and employed in the safe region. Further, the terminal board 300 may apply a first voltage to the first loop line 11 through the first connection line 21 which is connected to a portion of the first loop line 11 which is arranged in the safe region and likewise may sense the change in current, or voltage (i.e. a second voltage) on the second loop line 12 through the second connection line 22 connected to a portion of the second loop line which is arranged in the safe region. Here, for example, the first voltage may be a direct current voltage of 17 to 26V (referred to as +VDD or "+voltage"), and the second voltage may be a common voltage (referred to as a ground voltage or "−voltage" having a specific voltage value).

The terminal board 300 may be controlled by a CPU 400 and the terminal board 300 may supply an operating power to the sensor 100 by applying the first voltage through the first connection line 21. And the terminal board 300 may load predetermined information (e.g., call information) provided by the CPU 400 in to the first voltage so as to transmit the information to the sensor 100 (an additional voltage waveform corresponding to the information to be transmitted is added to the first voltage). Further, the terminal board 300 may receive transmitted information from the sensor (e.g., sensed information) and transmit the received information to the CPU. That is, the terminal board 300 monitors the amount of current on the second connection line 22 and analyzes transmitted information from the sensor based on the change indicated in the amount of current. Further, the change of the voltage may also be monitored by detecting the second voltage shown in the second connection line 22.

The sensor 100 is normally arranged around the dangerous region and monitors the present state of the surrounding environment. For example, the sensor 100 may include a fire detecting sensor, a temperature sensor, a smoke sensor, a gas sensor, an open-close detector, a motion sensor, a manually operable switch, an explosion sensor, a flame sensor, etc. And, the sensor 100 may monitor the environment state corresponding to a given function and generates digital information (i.e., sensed information) indicating a monitored result.

The sensor 100 operates by being supplied with the first voltage from the first loop line 11 and being supplied with the second voltage from the second loop line 12. The sensor 100 continually performs the monitoring operation while the power being supplied, and if predetermined call information loaded to the first voltage is received through a power line communication scheme, the sensor 100 consumes a current corresponding to the first voltage according to a waveform corresponding to a sensed information. The change in the amount of current may occur by consumption of the current, and the terminal board can receive information which is transmitted from the sensor. To this end, the sensor 100 includes a resistor having a large load and is configured to turn on or off the circuit connection to the resistor in response to the waveform of the sensed information. Hereby, the current consumption by the first voltage occurs in the resistor, and as the second voltage is changed by this current consumption, the power line communication between the sensor 100 and the CPU 400 may be achieved.

Here, the respective unique IDs may be set to the respective sensors. During the operation, the respective sensors check continually the first voltage applied from the first loop line and separate call information from the first voltage having call information loaded. In this way the respective sensors can monitor whether a unique ID, which is set to the sensor itself, is called. And in a sensor, if the unique ID is called, an inner load is turned on/off during a specific preset time or simultaneously with the reception of call information so that the large current is consumed to transmit the currently generated sensed information.

The central processing unit (CPU) 400, controls operations of the terminal board 300 by controlling a related electronic circuitry; applies the first voltage and the second voltage to the sensor 100; outputs call information in the manner of loading (modulating) pulses or additional voltage on the first voltage during predefined periods; and unloading (demodulating) sensed information in the manner of detecting the change in current or voltage from the second voltage during other period or simultaneously with transmission. The central processing unit 400 confirms the current environment state around the sensor, by analyzing the received sensed information, determines whether there occurred the disaster, and performs the process of issuing an alarm corresponding to the result thereof.

Further, each sensor 100 is coupled with the first loop line 11 or the second loop line 12 through the isolator circuit 200.

When the first loop line 11 and the second loop line 12 become short, the isolator circuit 200 disconnects (open) the line where a short circuit occurred, by adjusting an internal circuit of the isolator circuit 200. Further, if the circuits of two isolators which are arranged at opposing sides of the location where a short circuit occurred are all changed to the disconnected state, the location where a short circuit occurred may be completely isolated. That is, the line is equivalent to a cut line ended with the isolator circuit.

Generally, in the fire and gas detection system, when the line in a dangerous region is disconnected, the power supply and power line communication to the sensor 100 may be maintained, but when the lines become short, the power supply to the sensor 100 become impossible and thus the sensors cannot operate. Hence, the fire and gas detection system having the bidirectional communication function according to the present embodiment guarantees the operation of the system by disconnecting opposing sides of the short circuited location when the lines become short, by adding the isolator circuit 200.

The barrier 250 is arranged on the first connection line 21 and the second connection line 22 to relay the connection between the terminal board 300 and the fire and gas detection system.

That is, the barrier 250 performs functions of blocking the terminal board 300 and the CPU 400 in case there occurs a disconnection or a short circuit of the lines (particularly, the first and second loop lines) configuring to the fire and gas detection system, or in case there occurs a disconnection or a short circuit at the internal circuit of the sensor according to the breakdown of the sensor.

In particular, the barrier 250 monitors the generation of a short circuit in the rear side, i.e., in the lines in the dangerous region, and isolates the lines of the front side, i.e., the lines of the safe region from the lines of the dangerous region, in case a short circuit occurs. Hereby, the barrier 250 also causes a short between the lines occurred in the fire and gas detection system, to be processed as a disconnection of the lines. Such a barrier 250 may also be configured by utilizing an isolator circuit.

Further, in the present embodiment the lines installed in the dangerous region, are formed in a loop shape, and one or more sensors (8 sensors in FIG. 2) are arranged on the lines in the loop shape.

According to such a configuration, for example, when there is a disconnection on the lines between sensor no. 4 and sensor no. 5, the first voltage and the second voltage may be normally still applied to each sensor. Hence, the sensing operation and communication operation of the fire and gas detection system may be normally maintained.

That is, the fire and gas detection system having the bidirectional communication function according to the first embodiment may guarantee normal operations even when there is a disconnection and/or a short circuit at a certain location of the first loop line and the second loop line which are arranged in the dangerous region.

Figure 3:
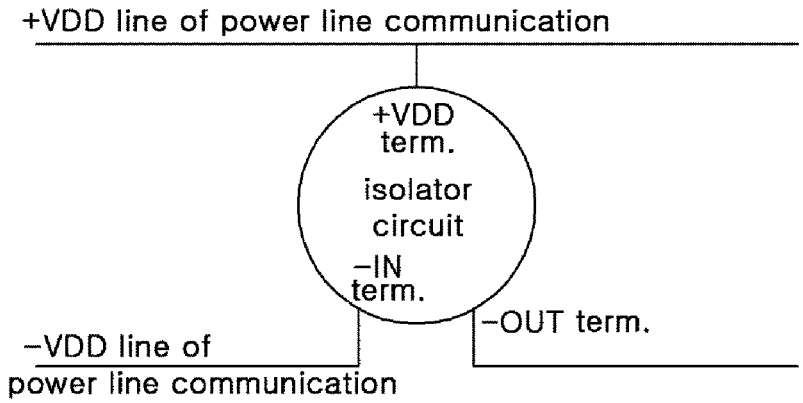
FIG. 3 is a diagram illustrating a basic configuration of an isolator circuit according to an embodiment of the present invention.

The internal circuit configuration and operation of an isolator circuit, which is applied to the present invention, will be described in detail with reference to FIGS. 3 to 6. First, FIG. 3 illustrates the basic configuration of an isolator circuit which is implemented in the present invention.

The isolator circuit 200 guarantees the continuity of a first line (it may be the first loop line and/or the first connection line) and a second line (it may be the second loop line and/or the second connection line) in the normal state. Further, the isolator circuit operates to block a short circuit between +VDD voltage (a first voltage) of the first line and −voltage (a second voltage; −VDD in figures) of the second line, by disconnecting at least one line (particularly, the second line) of the first line and the second line in an abnormal state where a short circuit of the lines is detected.

Such an isolator circuit 200 includes +VDD terminal branched from the first line. Further, the isolator circuit 200 includes −IN terminal connected to one cut end of the second line, and −OUT terminal connected to the other cut end thereof.

In such a configuration, the isolator circuit 200 may operate by using +VDD voltage. In the normal state, the isolator circuit operates such that the continuity of the second line may be guaranteed by electrically connecting −IN terminal and −OUT terminal together. And in the abnormal state, the isolator circuit operates such that the second line may be disconnected (opened) by isolating −OUT terminal from both +VDD terminal and −IN terminal.

Figure 4:
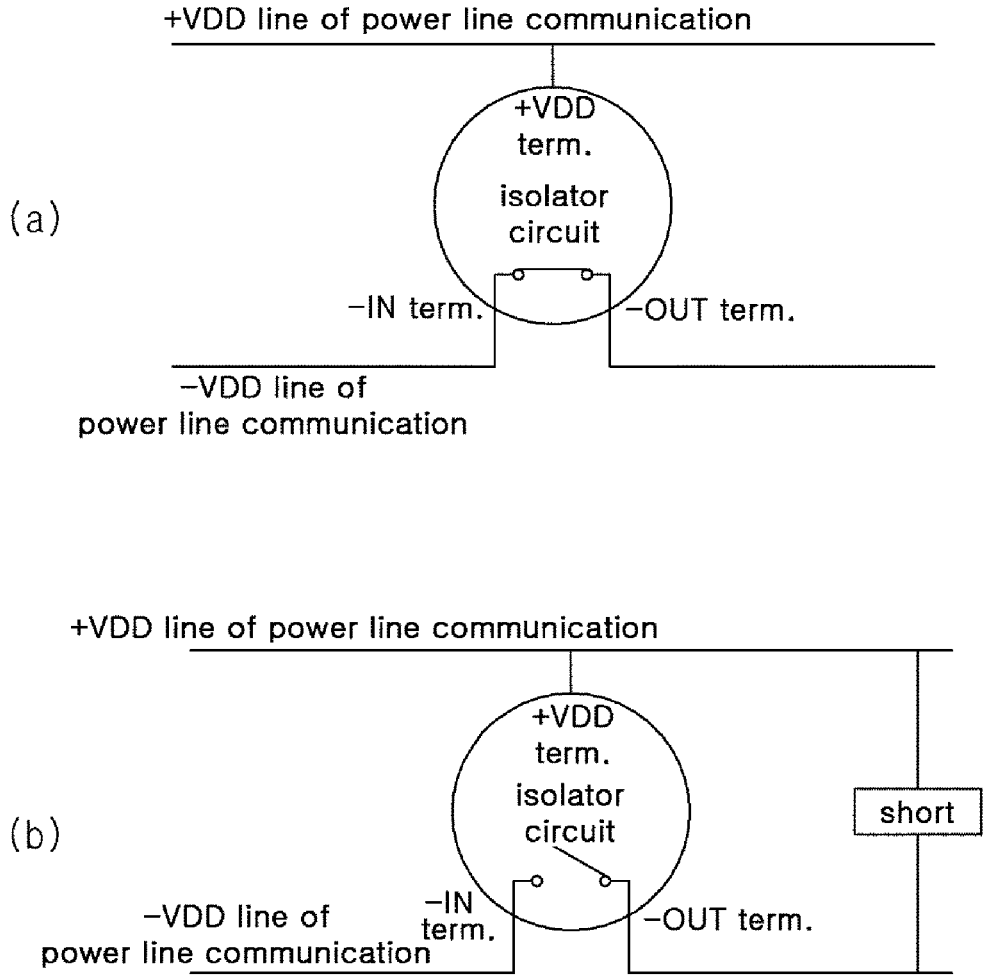
FIG. 4 is a conceptual diagram for explaining an operation of the isolator circuit.

Such an operation may be understood with reference to the equivalent configuration of FIG. 4, and when a short circuit occurs in the line on the side of −OUT terminal, the line of −OUT terminal may be disconnected from −IN terminal.

That is, the continuity of the first line and the second line may be maintained as −IN terminal and −OUT terminal are connected together in FIG. 4(*a*). Hence, any device connected to the rear side of the isolator circuit may be maintained the operation and functionality of the power line communication by using +VDD voltage and −voltage.

Further, in FIG. 4(*b*), −IN terminal and −OUT terminal are isolated because a short circuit between the lines occurs at the rear side of the isolator circuit. Hereby, the same effects as those of the disconnection of the lines are obtained on the isolator circuit.

Figure 5:
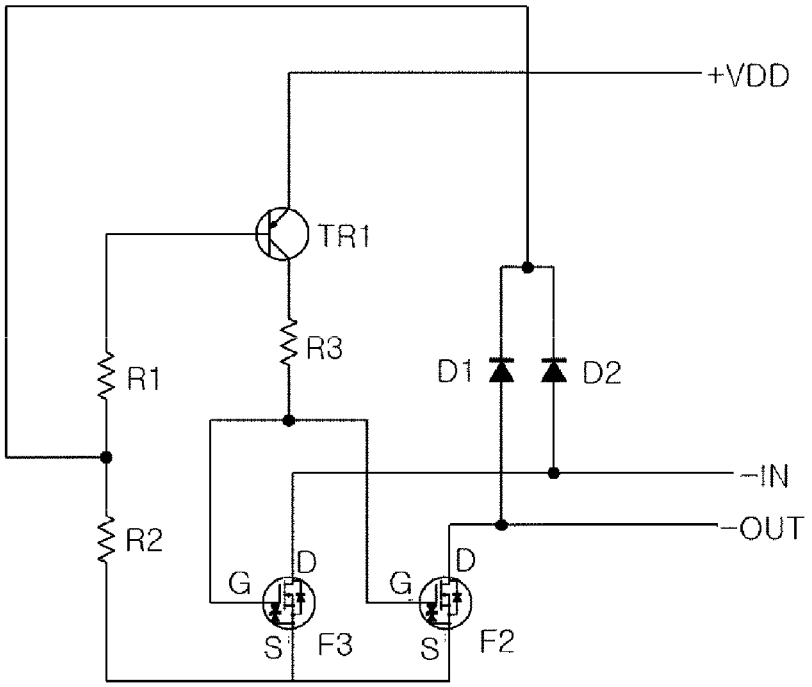
FIG. 5 illustrates the internal circuit configuration of an inner circuit of the isolator circuit.

FIG. 5 illustrates the circuit configuration of an internal circuit of an isolator circuit. As illustrated, the isolator circuit includes: a first diode D1 an anode of which is coupled to −OUT terminal; a second diode D2 an anode of which is coupled with −IN terminal and a cathode of which is coupled with a cathode of the first diode D1; a first resistor R1 and a second resistor R2 one ends of which are respectively coupled with the cathodes of the first and second diodes; a first switching device TR1 the base of which is coupled with the other end of the first resistor R1 and the emitter of which is coupled with +VDD terminal; a second switching device F2 a drain of which is coupled with −OUT terminal and the source of which is coupled with the other end of the second resistor; a third switching device F3 a drain of which is coupled with −IN terminal and a source of which is coupled with the other end of the resistor R2; and a third resistor R3 one end of which is coupled with the collector of the first switching device TR1 and the other end of which is coupled commonly with the gates of the second switching device F2 and the third switching device F3.

Here, the first switching device TR1 may be a PNP transistor and the second and third switching devices may be N channel FETs.

Figure 6:
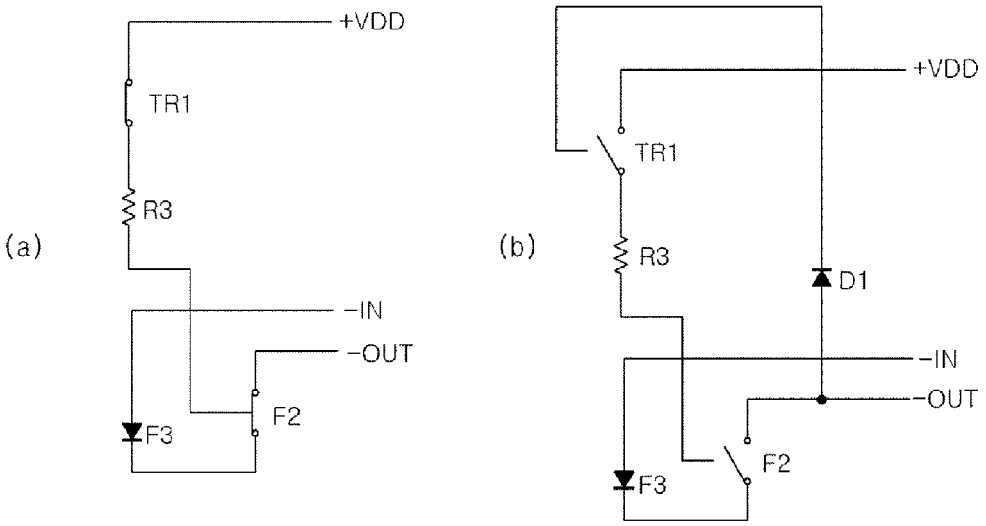
FIG. 6 is an equivalent circuit diagram for explaining an operation of the isolator circuit.

The equivalent circuit diagram for explaining the operation of the isolator circuit having such a configuration is illustrated in FIG. 6.

FIG. 6(*a*) illustrates a case which operates in a normal state. First, if +VDD voltage is applied to +VDD terminal, and, for example, −voltage is applied to −IN terminal, (1) −voltage is applied to the switching device F3, so that a source side line of the switching device F3 becomes −voltage; (2) The voltage applied in the emitter side of the switching device TR1, generates weak current flowing through the resistor R1 and the resistor R2. (3) If weak current flows through the switching device TR1, a certain voltage is generated to the resistor R3. (4) Thus a voltage is applied also to the gates of the switching devices F2 and F3 and then the switching devices F2 and F3 are turned on. (5) A −voltage applied to the switching device F3 is applied to −OUT terminal through the switching device F2 which is at an on state.

Further, FIG. 6(*b*) illustrates the operation of the isolator circuit when +VDD voltage is detected even at −OUT terminal, i.e., in an abnormal state in which the first line and the second line are short-circuited. (1) If the first line to which +VDD voltage is applied and the second line to which −voltage is applied are short-circuited, a short-circuit voltage, i.e., +VDD voltage, is applied to the resistor R1 through the diode D1. (2) As +VDD voltage is applied to the switching device TR1 through the resistor R1, a current does not flow from the emitter to collector of the switching device TR1. (3) Thus, because an current does not flow through the resistor R3 and a voltage is not applied to the switching device F2, the switching device F2 is at an off state. (4) The −voltage is not applied from −IN terminal to −OUT terminal, and thus −OUT terminal is isolated from −IN terminal. Here, −IN terminal is not directly connected to +VDD terminal, and thus both terminals are isolated from each other.

According to an embodiment of the present invention which is implemented as the above-described circuit configuration, the isolators 200 are connected in parallel with the power supply lines composed of the first line and the second line, and thus when a short circuit of the first line and the second line occurs in the rear side of a certain isolator circuit 200 (i.e., in the case that −voltage from the terminal board is connected to −IN terminal, the location in which a short circuit occurs may be the line at −OUT terminal side), the connection between −IN terminal and −OUT terminal of the isolation 200 may be released so that the lines may be operated as if they were disconnected. Hereby, even when the power supply line becomes short, the bidirectional communication function may be maintained.

Figure 7:
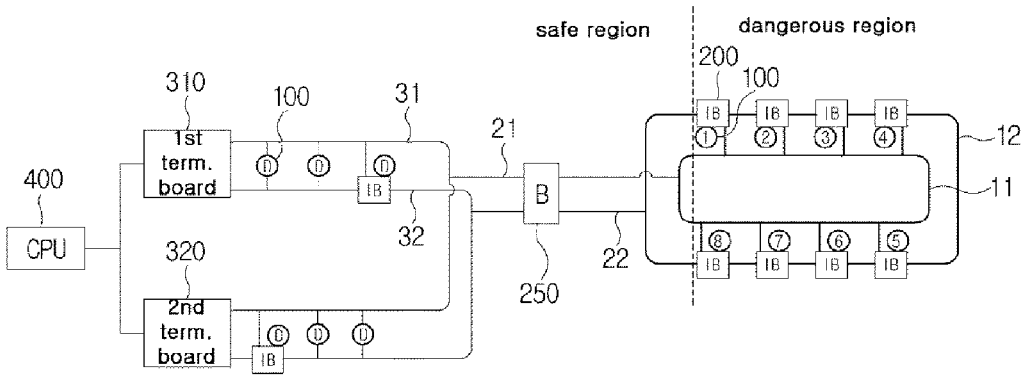
FIG. 7 is a conceptual diagram illustrating the internal circuit configuration of the fire and gas detection system having the bidirectional communication function according to a second embodiment of the present invention.

Hereinafter, referring to FIG. 7, the internal circuit configuration of the fire and gas detection system having the bidirectional communication according to a second embodiment of the present invention will be described.

First, a first fire and gas detection system having a bidirectional communication function is provided. The first fire and gas detection system includes the first terminal board 310 and the second terminal board 320 to which both +line 31 and −line 32 are connected. Both terminal boards 310 and 320 perform power line communication by outputting the first voltage from and then monitoring the second voltage simultaneously. Thereby, the first fire and gas detection system can normally operate even when +line 31 or −line 32 are disconnected.

Further, as in the above first embodiment, a first loop line 11 and a second loop line 12, a part of which are arranged to pass through a dangerous region and the other part of which are arranged in a safe region, constitute closed loops, respectively, and a plurality of sensors 100 are installed in the closed loops. Thereby, a second fire and gas detection system is prepared.

Further, a first connection line 21 which connects on side of +line 31 of the first fire and gas detection system with the first loop line 11 of the second fire and gas detection system which is arranged in a safe region, and a second connection line 22 which connects one side of −line 32 with the second loop line 12 of the second fire and gas detection system which is arranged in a safe region, is provided.

At this time, a barrier 250, which intervenes between the first fire and gas detection system and the second fire and gas detection system, is arranged in the middle of the first connection line 21 and the second connection line 22. The barrier 250 is a device for performing functions of isolating the second fire and gas detection system from the first fire and gas detection system, and thus eliminate some problems which occur when there is a disconnection or short circuit in the lines of the second fire and gas detection system or there is a disconnection or short circuit in a internal circuit of the sensor according to the breakdown of the sensor.

In particular, the barrier 250 senses generation of a short circuit in the lines in the rear side of the second fire and gas detection system, i.e., the dangerous region, and isolates the lines in case the short circuit occurs. Hereby, the barrier 250 allows the short circuit of the second fire and gas detection system to be handled as disconnected circuit thereof, and thus the first fire and gas detection system is normally operated.

Further, the voltage for sensors in a general safe region may be defined as 17 to 28V. However, in a dangerous region, relative low voltage of 14 to 24V is specified to be used in order to prevent the spark or overheat which may occurs in case of disconnection or short of lines.

Hence, the barrier 250 may have a function of converting the voltage of 17 to 28V which is supplied from +line and −line of the first fire and gas detection system into the voltage of 14 to 24V which is to be used in the second fire and gas detection system.

Further, the barrier 250 may also include a function of protocol conversion. That is, the first fire and gas detection system is designed so that the power line communication is performed by using the signal having for example, the amplitude of 5 to 9V. But, applying such a signal to the second fire and gas detection system may be restricted due to the explosion prevention, etc. In such a case, the barrier 250 may convert the protocol for the power line communication having the amplitude of 5 to 9V, which is transmitted from the lines of the first fire and gas detection system, into a safe signal having the amplitude within the voltage which may be allowable to the dangerous region.

According to the fire and gas detection system having the bidirectional communication function of the above configuration, the respective sensors which are arranged in the dangerous region may be protected from the disconnection and short circuit of the lines by the respective isolation circuits, and all sensors in the dangerous region may be protected by the barrier. That is, in case the first loop line and the second loop line become short, the damage on the sensors connected to the lines may be prevented.

Further, even when disconnections or short circuits occur in a plurality of points of the lines in the dangerous region or a plurality of sensors in the dangerous region are broken down, the barrier B may finally isolate the lines of the dangerous region, and thus harmful effects of the breakdown in a plurality of points in the lines over the dangerous region on the fire and gas detection system in the safe region, may be minimized.

Figure 8:
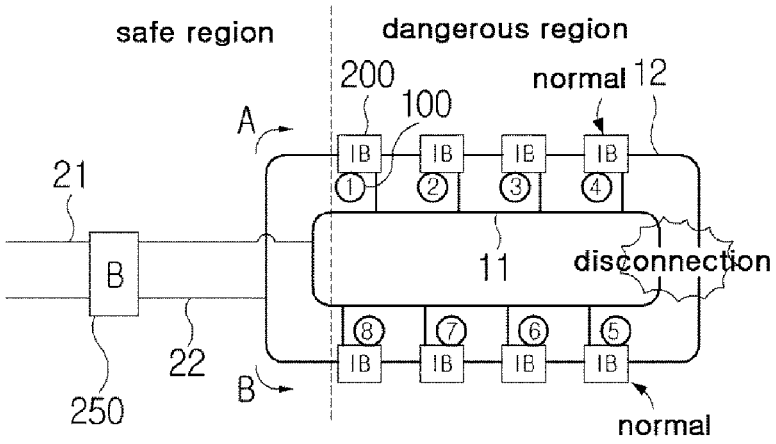
FIG. 8 is a diagram for explaining an operation when a part of lines within the dangerous region is disconnected in the fire and gas detection system according to a second embodiment of the present invention.

FIG. 8 is a diagram for explaining the operation when part of the lines within the dangerous region in the fire and gas detection system is disconnected according to the second embodiment of the present invention. As shown in FIG. 8, even if the line between the sensor no. 4 and sensor no. 5 is disconnected, sensors no. 1 to 4 may be supplied with +VDD voltage and −voltage through the upper lines A of the first loop line 11, and sensors no. 5 to 8 may be supplied with +VDD voltage and −voltage through the lower lines B. Here, the power line communication function having the reception of the call information by +VDD voltage and the transmission of sensed information according to the change in the current by −voltage, is also valid.

Figure 9:
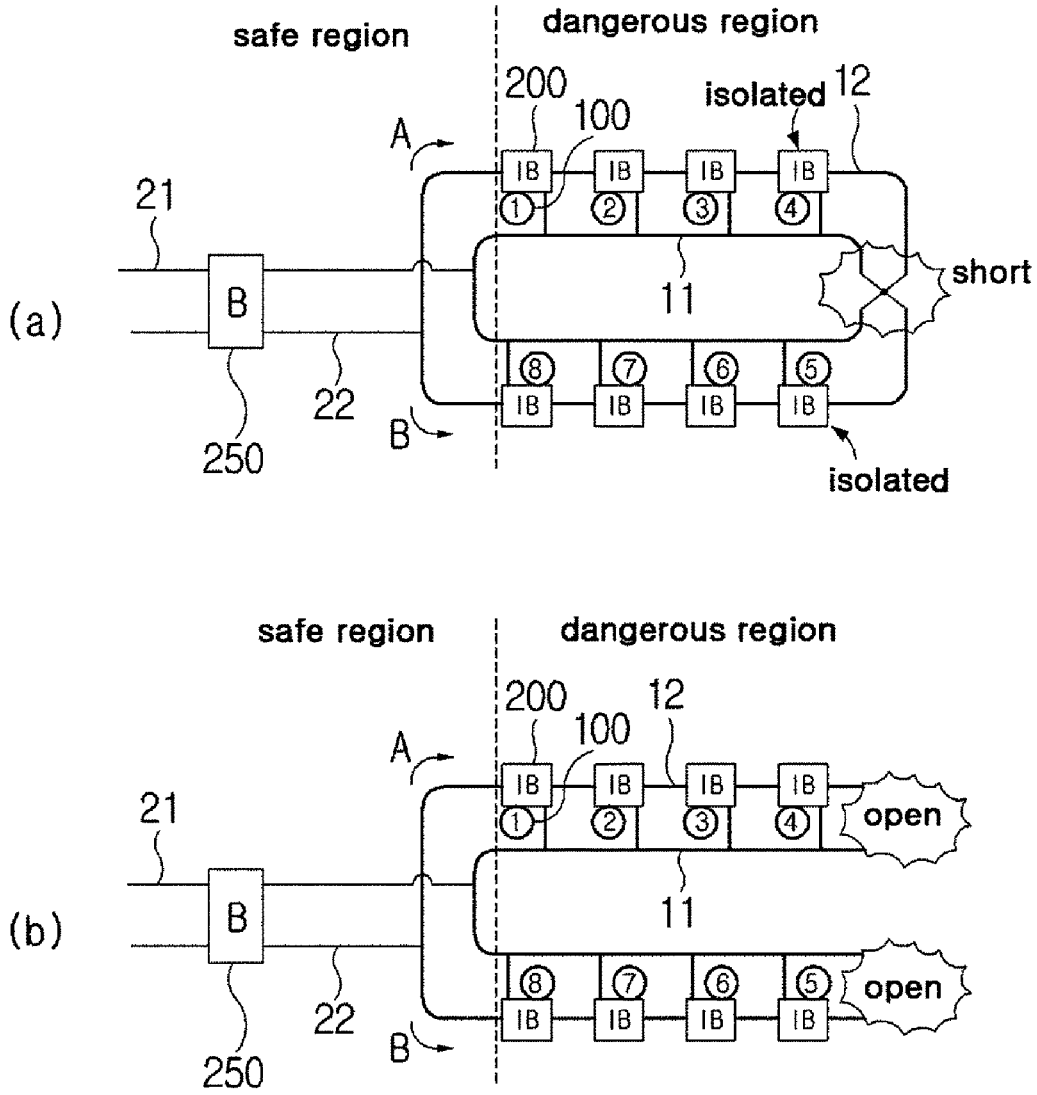
FIG. 9 is a diagram for explaining an operation when a short circuit occurs in a part of the lines within the dangerous region in the fire and gas detection system according to a second embodiment of the present invention.

FIG. 9 is a diagram explaining the operation in case a short circuit occurs in part of the lines within the dangerous region in the fire and gas detection system according to the second embodiment of the present invention. For example, as shown in FIG. 9(*a*), if the first loop line 11 and the second loop line 12 become short in a point between sensor no. 4 and sensor no. 5, the isolator circuit of sensor no. 4 and the isolator circuit of sensor no. 5 may respectively isolate a short point from the second loop line 12. Hereby, it may appear that the lines are disconnected between sensor no. 4 and sensor no. 5 as shown in FIG. 9(*b*). Because the lines are disconnected, the power supply and power line communication can be maintained.

According to the fire and gas sensing system which is installed in a dangerous region and has a bi-directional communication function according to the present invention, even when the line (first line or first loop line), to which +voltage (first voltage) is applied, and the line (second line or second loop line), to which −voltage (second voltage) is applied, in the dangerous region, are disconnected or is shorted, the power supplying and the power line communication function may be maintained, and thus a fire and gas sensing system having a highly reliable bi-directional communication function may be provided.

That is, the situation of disconnection of the line can be appropriately handled by forming the line within the dangerous region in the form of a loop, and the situation of the short circuit of the line can be appropriately handled by applying the isolator circuit.

Further, by implementing the line installed in the dangerous region to be isolated through the additional isolator circuit, the monitoring system of the dangerous region may be safely isolated in case there is a problem in the line in the dangerous region.

The above description is simply illustrative of the technical concept of the invention and a person skilled in the art can make considerable modifications, alterations and equivalents in form and functions without departing beyond the scope of the invention. Therefore, since the embodiments disclosed in the invention is not intended to limit the scope of the invention but to describe the invention, the scope of the invention should not be limited by these embodiments. The scope of the invention should be interpreted on the basis of the following claims and all technical concepts within the equivalent range thereof should be interpreted as being included in the scope of the invention.

What is claimed is:

1. A fire and gas detection system having a bidirectional communication function and installed within a dangerous region, the fire and gas detection system comprising:

a first terminal board including a first terminal for outputting a first voltage and a second terminal for outputting a second voltage; and a second terminal board including a third terminal for outputting the first voltage and a fourth terminal for outputting the second voltage;

+line which connects the first terminal with the third terminal; and −line which connects the second terminal with the fourth terminal;

a first loop line, which is a line formed in the form of a closed loop, wherein a part of the loop is arranged in the dangerous region with a possibility of disaster occurrence and the other part thereof is arranged in a safe region which is the remaining region except the dangerous region; and a second loop line which has the same type as that of the first loop line and is arranged in parallel to the first loop line;

a first connection line which is branched from the +line and is connected to the first loop line; and a second connection line which is branched from the −line and is connected to the second loop line;

a barrier which is installed between the first connection line and the second connection line, and disconnects the first connection line and the second connection line respectively when a short circuit between the first loop line and the second loop line is detected;

a sensor which is connected to the first loop line and the second loop line within the dangerous region, is operated by the first voltage supplied through the first loop line, is generates sensed information by sensing a surrounding environment, and transmits the sensed information by modulating the second voltage if a predetermined call information is received by demodulating the first voltage; and a central processing unit (CPU) which controls the first and second terminal boards so that the call information which designates the sensor is modulated and outputted in addition to the first voltage and the sensed information which is transmitted from the sensor is demodulated from the second voltage, and performs an alarm process of occurrence of fire or gas in response to the demodulated sensed information.

2. The fire and gas detection system according to claim 1, wherein the sensor comprises at least one of a fire detecting sensor, a temperature sensor, a smoke sensor, a gas sensor, an open-close detector, a motion sensor, a manually operable switch, an explosion sensor, and a flame sensor.

3. The fire and gas detection system according to claim 1, further comprising:

an isolator circuit which includes +VDD terminal which is coupled with the first loop line; −IN terminal which is coupled with one cut end of the second loop line which has been cut; −OUT terminal which is coupled with the other cut end thereof; and a driving circuit unit which connects the −IN terminal with the −OUT terminal if the first voltage is applied to the +VDD terminal only, and isolates the −OUT terminal from the −IN terminal if the first voltage is applied also to the −OUT terminal while the first voltage is applied to the +VDD terminal.

4. The fire and gas detection system according to claim 3, wherein the driving circuit unit of the isolator circuit comprises:

a first diode, an anode of which is coupled with the −OUT terminal;

a second diode, an anode of which is coupled with the −IN terminal and a cathode of which is coupled with a cathode of the first diode;

a first resistor and a second resistor, one ends of which are respectively coupled with the cathodes of the first and second diodes;

a first switching device, a base of which is coupled with the other end of the first resistor and an emitter of which is coupled with the +VDD terminal;

a second switching device, a drain of which is coupled with the −OUT terminal and a source of which is coupled with the other end of the second resistor;

a third switching device, a drain of which is coupled with the −IN terminal and a source of which is coupled with the other end of the second resistor; and a third resistor, one end of which is coupled with a collector of the first switching device and the other end of which is commonly coupled with gates of the second and third switching devices.

5. The fire and gas detection system according to claim 4, wherein the first switching device is a PNP transistor, and the second and third switching devices are N channel FET.

6. The fire and gas detection system according to claim 2, further comprising:

an isolator circuit which includes +VDD terminal which is coupled with the first loop line; −IN terminal which is coupled with one cut end of the second loop line which has been cut; −OUT terminal which is coupled with the other cut end thereof; and a driving circuit unit which connects the −IN terminal with the −OUT terminal if the first voltage is applied to the +VDD terminal only, and isolates the −OUT terminal from the −IN terminal if the first voltage is applied also to the −OUT terminal while the first voltage is applied to the +VDD terminal.

7. The fire and gas detection system according to claim 6, wherein the driving circuit unit of the isolator circuit comprises:

a first diode, an anode of which is coupled with the −OUT terminal;

a second diode, an anode of which is coupled with the −IN terminal and a cathode of which is coupled with a cathode of the first diode;

a first resistor and a second resistor, one ends of which are respectively coupled with the cathodes of the first and second diodes;

a first switching device, a base of which is coupled with the other end of the first resistor and an emitter of which is coupled with the +VDD terminal;

a second switching device, a drain of which is coupled with the −OUT terminal and a source of which is coupled with the other end of the second resistor;

a third switching device, a drain of which is coupled with the −IN terminal and a source of which is coupled with the other end of the second resistor; and a third resistor, one end of which is coupled with a collector of the first switching device and the other end of which is commonly coupled with gates of the second and third switching devices.

8. The fire and gas detection system according to claim 7, wherein the first switching device is a PNP transistor, and the second and third switching devices are N channel FET.

9. A fire and gas detection system having a bidirectional communication function and installed within a dangerous region, the fire and gas detection system comprising:

a first loop line and a second loop line which are formed in the form of a closed loop and are parallel to each other, wherein a part of the loop form is arranged in the dangerous region with a possibility of disaster occurrence, and the remaining part thereof is arranged in a safe region which is the remaining region except the dangerous region;

a barrier which is coupled with the first loop line and the second loop line of the safe region, applies a first voltage to the first loop line, and releases the coupling with the first loop line and the second loop line when a short circuit between the first loop line and the second loop line is detected;

a sensor which is operated by the first voltage supplied through the first loop line generates sensed information by sensing a surrounding environment within the dangerous region, and transmits the sensed information by modulating a second voltage of the second loop line if a predetermined call information is received by demodulating the first voltage; and a central processing unit (CPU) which is coupled with the barrier, demodulates the sensed information transmitted from the sensor with the second voltage while modulating the call information which designates the sensor and outputting the modulated information to the first voltage, and performs an alarm process of occurrence of fire and gas, in response to the demodulated sensed information.

10. The fire and gas detection system according to claim 9, further comprising an isolator circuit which includes, +VDD terminal which is coupled with the first loop line; −IN terminal which is coupled with one cut end of the second loop line which has been cut; −OUT terminal which is coupled with the other end thereof; and a driving circuit unit which connects the −IN terminal with the −OUT terminal if the first voltage is applied to the +VDD terminal only, and isolates the −OUT terminal from the −IN terminal if the first voltage is applied also to the −OUT terminal while the first voltage is applied to the +VDD terminal, wherein the sensor is connected to the first loop line and the second loop line through the isolator circuit.

* * * * *